United States Patent [19]

Stuart et al.

[11] 4,421,063

[45] Dec. 20, 1983

[54] FLUIDIZED BED COMBUSTION APPARATUS

[75] Inventors: Ronald B. Stuart, Dalbeattie; Alan G. Troup, Annan, both of Scotland

[73] Assignee: Northern Engineering Industries plc, Newcastle upon Tyne, England

[21] Appl. No.: 325,599

[22] Filed: Nov. 27, 1981

[30] Foreign Application Priority Data

Jan. 9, 1981 [GB] United Kingdom ..... 8100563

[51] Int. Cl.[3] ..... F23C 11/02

[52] U.S. Cl. ..... 122/4 D; 110/245

[58] Field of Search ..... 431/170; 122/4 D; 110/245, 234; 432/58

[56] References Cited

U.S. PATENT DOCUMENTS

| | | | |
|---|---|---|---|
| 4,259,088 | 3/1981 | Moss | 431/170 |
| 4,259,911 | 4/1981 | Jones | 122/4 D |
| 4,267,801 | 5/1981 | Robinson | 122/4 D |
| 4,270,468 | 6/1981 | Robinson et al. | 122/4 D |
| 4,273,073 | 6/1981 | Robinson | 122/4 D |
| 4,338,887 | 7/1982 | Leon | 110/245 |

*Primary Examiner*—Henry C. Yuen

[57] ABSTRACT

A boiler or other fluidized bed apparatus has an outlet from the bed and an outlet from the gas stream downstream of the bed for removing material from the bed and from the gas stream. The material removed is passed to screening mechanism which separates materials into relatively larger particles and relatively smaller particles. The smaller particles are fed by conveyor to means feeding the bed. The larger particles are mainly ash which is discarded. Removal of material from the bed under load is provided for.

4 Claims, 4 Drawing Figures

FLUIDIZED BED COMBUSTION APPARATUS

BACKGROUND OF THE INVENTION

It has been proposed, for example in UK Pat. No. 1522601 and in U.S. Pat. No. 4267801, to remove material from a fluidisable bed, to remove ash or other particles from that material and to return the remainder to the bed.

However, both of those proposals were directed to the removal of unwanted relatively larger particles from a relatively deep bed and in which the whole of the bed is given motion. Furthermore, in those proposals there was no requirement, and no provision, for the recovery of bed material carried away from the bed by gas stream leaving the bed.

The present invention is concerned with fluidised bed combustion apparatus in which in a containment for a bed of material means for introducing fluidising gaseous fluid into the material are arranged so as to fluidise material only in an upper zone of the containment and so as to leave in a lower zone of the containment a layer of quiescent material. The quiescent layer protects the boundary of the containment beneath the layer.

In such apparatus the depth of bed material in the containment is relatively small. In order that the accumulation of incombustible residues from fuel shall not rise to excessive levels it is necessary to remove a mixture of bed material and such accumulating residues from the containment. A further proportion of material containing a mixture of at least bed material and relatively smaller, buoyant particles of incombustible matter from fuel leaves the containment in the gas stream flowing away from the containment.

Accordingly, the following requirements arise:

(1) the materials in the gas stream will ultimately fall out from the gas stream and accumulate elsewhere in the apparatus. That accumulation must be removed from the location at which it occurs;

(2) bed material is lost at a significant rate from the containment and as much as practicable must be recovered from the mixtures aforesaid and returned to the containment, while as high a proportion as practicable of incombustible matter from fuel and particularly relatively larger particles, is removed from the apparatus; and (3) the removal of incombustible residues accumulated in the containment must be such as to leave enough of the quiescent layer to protect at least the vulnerable part of the underlying boundary of the containment.

The teaching of the prior proposals referred to above is not applicable to such apparatus and cannot meet the requirements which have just been explained, whereas the apparatus according to the invention does meet those requirements.

BRIEF SUMMARY OF THE INVENTION

Fluidised bed combustion apparatus according to the invention comprises a containment for a bed of material, distributor means in the containment for introducing fluidising gaseous fluid into the material which distributor means are arranged so as to fluidise material only in an upper zone of the containment and so as to leave in a lower zone of the containment a layer of quiescent material overlying a lower boundary of said containment, gas path structure including a horizontal furnace duct extending from said containment, first means forming a first route leading from within said containment, second means forming a second route leading from within said gas path structure downstream of said containment, said routes leading to screening mechanism operable to separate materials into a first class of relatively larger particles and a second class of relatively smaller particles including bed material and third means forming a return route for said second class of particles leading from said screening mechanism back to said containment, said first means being arranged to receive material from said upper zone and to leave said quiescent layer overlying said lower boundary of said containment.

Preferably, said first means comprises conduit means defining entrance means thereto at a level higher than said lower boundary of said containment coincident with a level at which said distributor means introduces said fluidising medium into said material.

Preferably, two conduits are provided having upper ends coincident with the level of outlets for fluidising fluid defined by hollow members upstanding from support structure having an upper surface included in said lower boundary, said containment at a downstream end thereof comprising a wall upstanding higher than said hollow members and said conduits extend past said support structure beyond upstream and downstream ends thereof and said second conduit extends within said wall of said containment.

Apparatus will now be described by way of example to illustrate the invention with reference to the accompanying drawings, in which:

DETAILED DESCRIPTION OF THE PREFERRED EMBODIMENTS

Figure 1:
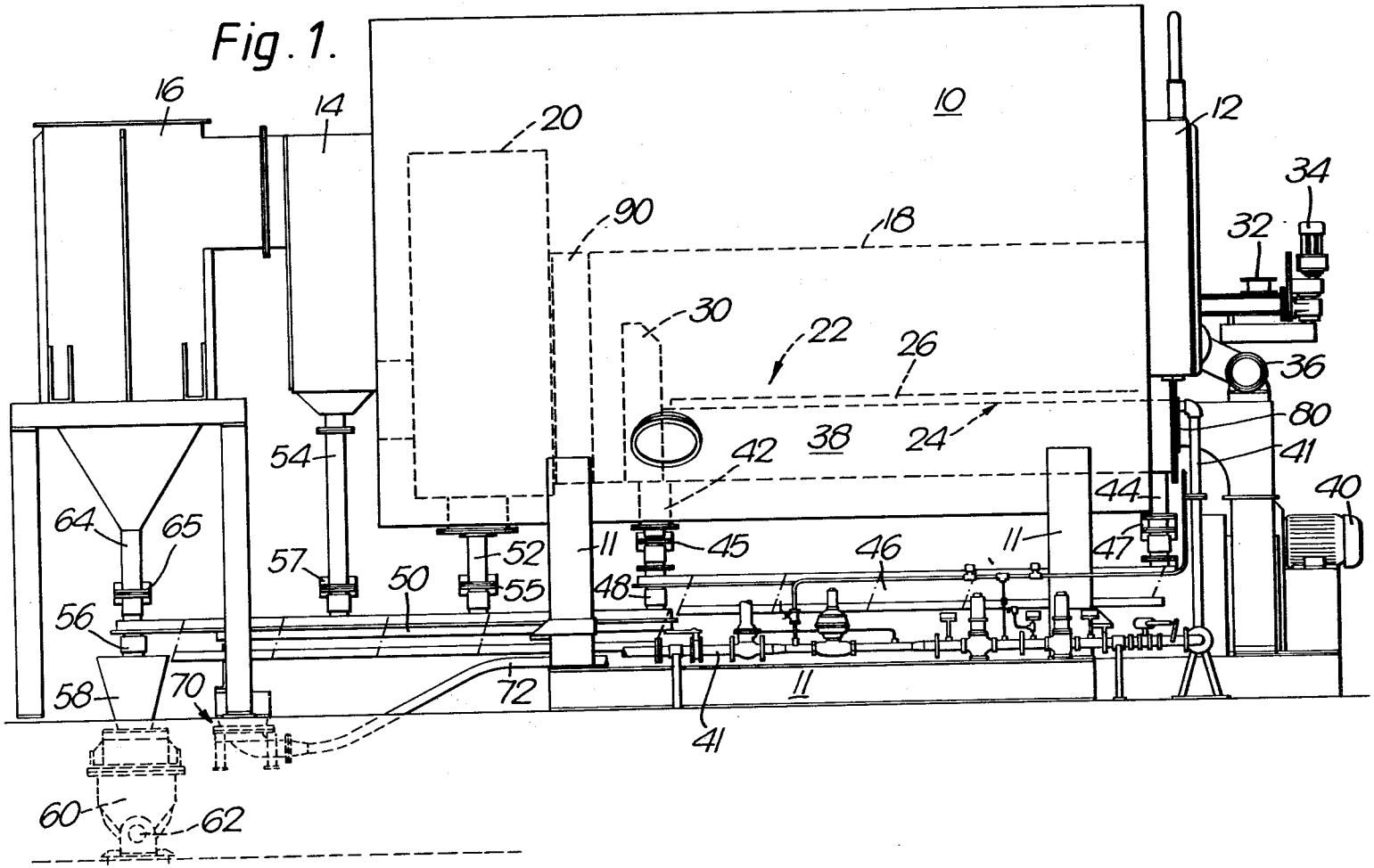
FIG. 1 is a side elevation of one form of apparatus, being a boiler.

The boiler shown in the drawings is a shell boiler having the following main components: a cylindrical shell 10 supported by a framework 11; a front smokebox (in two parts) 12; a rear smokebox 14; a grit arrestor 16; a horizontal cylindrical furnace tube 18 extending through the water volume within the shell 10 and opening at its rear end into a cylindrical combustion chamber 20 of the "wet back" type.

The shell front and rear walls are supported by horizontal stays (not shown) interconnecting the walls and extending through the water volume and further stays (not shown) interconnect the rear shell wall and the rear wall of the combustion chamber 20 and yet others (not shown) interconnect the front shell wall and the front wall of the combustion chamber 20.

A pass of smoketubes in two banks (not shown) extends from the combustion chamber 20 through the water volume to the respective front smokebox parts 12 and a further pass (not shown) extends from between the front and rear smokeboxes 12 and 14, respectively. A smokestack (not shown) extends upwardly from the top of the grit arrestor 16.

A containment 22 for a fluidisable bed is made up of a horizontal support plate at 24 (carrying air nozzles represented diagrammatically by an envelope outline at 26); the furnace tube wall at each side; a rear bed retaining wall 30 of firebrick; and front firebrick retaining wall (not shown). The bed material in the containment 22 is, in this example, alumina having a mean particle size of 0.75 millimeter (mm) and maximum particle size close to that figure and less than 1.50 mm.

Coal is fed at 32 to a coal feeder driven by a motor 34 and passes to a spreader (not shown) driven by a motor 36. The coal is distributed by the spreader over the bed in the containment 22. Air is passed into a plenum chamber 38 beneath the plate 24 by a forced draught fan driven by a motor 40. Gas for igniting the coal is supplied through a conduit 41 including a valve arrangement.

Materials can be removed from the bed through front and rear conduits 44, 42, respectively, the open ends of which (not shown) are at a level approximately at the centres of the air outlets of the nozzles 26. Fluidised materials can flow down through the conduits 42, 44 when valves within the conduits at 45, 47 respectively are opened.

The conduits 42, 44 open into a casing 46 containing a conveyor which conveys the materials rearwardly of the boiler and discharges through a conduit 48 into a second casing 50. The casing 50 contains a combined conveyor and screen mechanism.

Conduits 52, 54 lead from the combustion chamber 20 and the rear smokebox 14, respectively, and open into the casing 50. Valves within the conduits 52, 54 at 55, 57, respectively are openable to allow materials to pass to the conveyor within the casing 50. The two conveyors together and the conduits 42, 44 and 48 form a first route for materials and the second conveyor and the conduits 52 and 54 form a second route for materials.

The screen mechanism separates materials into two classes, in the first of which the particle size is 1.50 millimeter (mm) or greater and in the second the particle size is below 1.50 mm.

The conveyor in the casing 50 conveys the first class of materials to a conduit 56 through which they are discharged to a hopper 58 and thence to mechanism 60 operable to propel the materials by air pressure through a conduit 62 to a point of disposal.

Fine grit particles are collected in the arrestor 16 and are discharged through a conduit 64 which contains a valve at 65 into the casing 50 and thence to the hopper 58 and mechanism 60.

The first class of particles includes relatively coarse ash removed from the bed in the containment 22 and ash from the combustion chamber 20 and rear smokebox 14 of particle size 1.50 mm and above.

The second class of materials comprises alumina and ash which pass through the screen and are conveyed by the conveyor in the casing 50 to a discharge conduit leading to a receiving vessel and mechanism at 70 operable to propel the materials along a conduit 72 which discharges within the furnace tube 18 so that the materials return to the containment 22. The conduit leading to the mechanism 70, the mechanism and the conduit 72 form a return route for the materials.

The interiors of the conduits 42, 44, 52, 54 above their respective valves, the vessel at 70, the conveyor 46, and the hopper 58 provide bunkering volume to ensure adequate capacity for the materials.

The conduit 42 leads from the lower end of vertical central alcove-like recess (not shown) in the bed retaining wall 30. The upper end of the recess faces towards the bed containment 22 and the lower part of the recess contains a hollow cylindrical liner the lower end of which opens into the conduit 42. The conduit 44 is outside the shell 10 immediately adjacent the front shell wall.

The front end of the furnace tube 18 has a closure 80. The inner face of the closure 80 carries a firebrick facing (not shown) the lower boundary of which is spaced above the support plate 24. The conduit 44 has an upward continuation (not shown) which has an open upper end at the level of the support plate 24 below the lower boundary of the fire-brick facing.

A baffle 90 made of firebrick extends across the furnace tube 18 and has passages (not shown) which extend through the baffle arranged to produce a relatively uniform distribution of flow of gas downstream of the baffle to reduce the carryover of bed material beyond the combustion chamber 20.

In a modification, not shown, both conveyors may be screening conveyors, the first classes of material from which are passed to disposal and the second classes of material from which pass back to the bed containment.

In the boiler described above with reference to FIGS. 1 and 2, the shell proper is a pressure vessel and is not shown. The shell proper is surrounded by thermal insulation (not shown) and by an outermost cylindrical casing of thin sheet steel having closed ends of similar material. Only that outer casing of the shell is shown at 10 in FIGS. 1 and 2. The conduit 44 extends from within the containment 22 out through the wall of the furnace duct 18 and then downwardly outside the shell proper. The furnace duct 18 protrudes at the right-hand end as shown in FIG. 1 out of the shell proper and also out of the outer casing 10. The conduit 42 extends through the wall of the furnace duct 18 and across the water space between the furnace duct 18 and the shell proper and then through the shell proper through the insulation and out through the casing 10.

Figure 2:
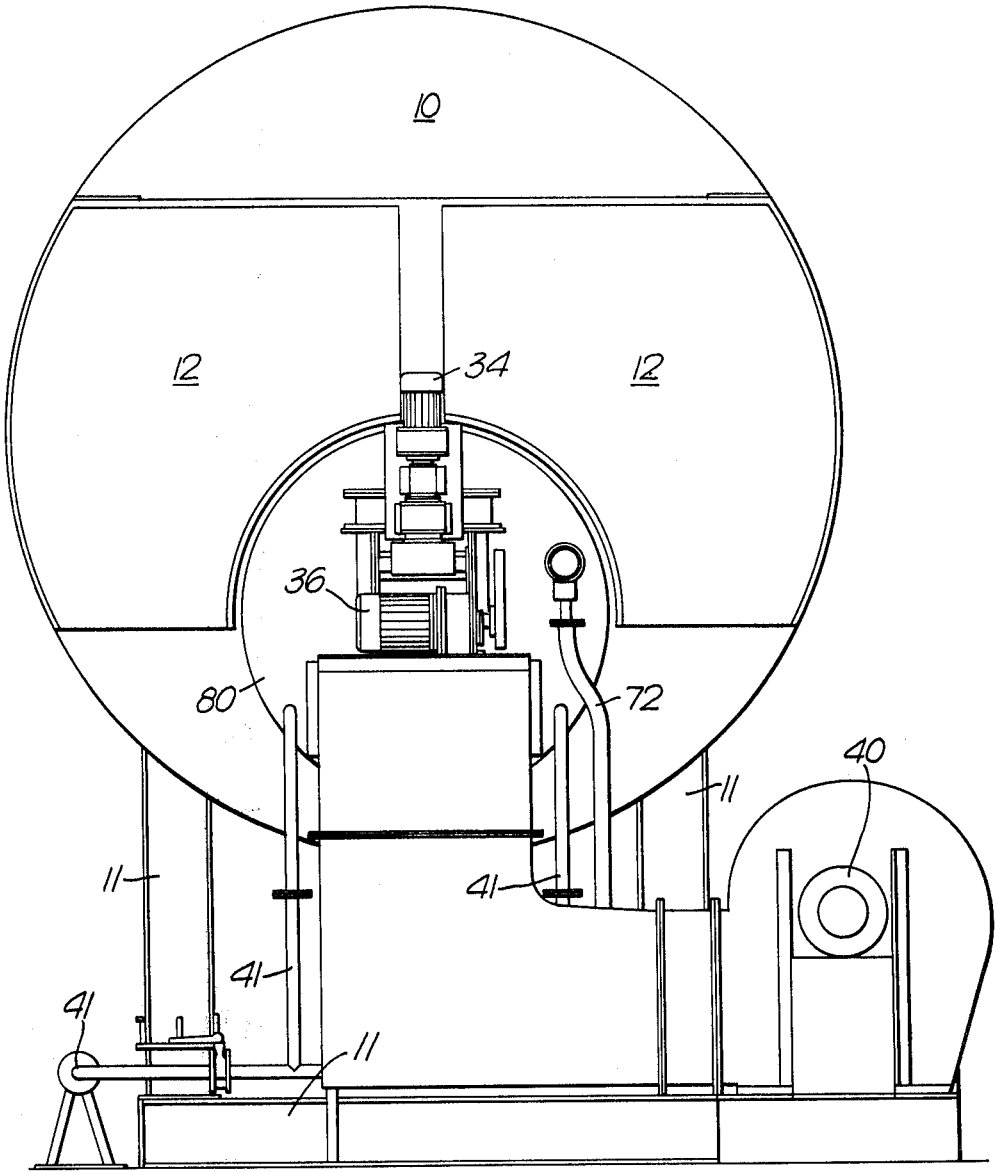
FIG. 2 is a front elevation of the boiler shown in FIG. 1.
Figure 3:
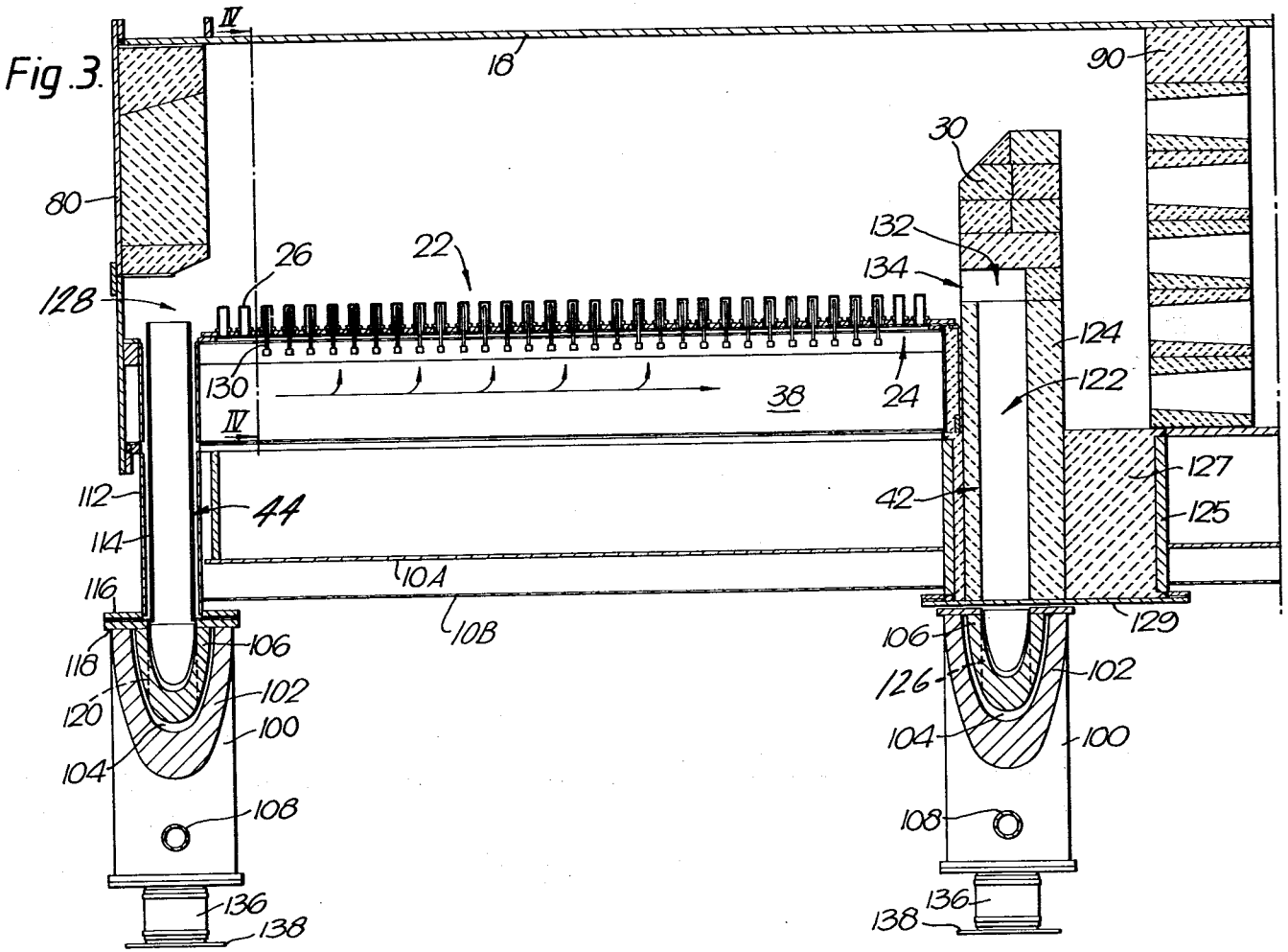
FIG. 3 is a vertical longitudinal section through the forward part of modified apparatus, also being a boiler on the line III—III in FIG. 4.
Figure 4:
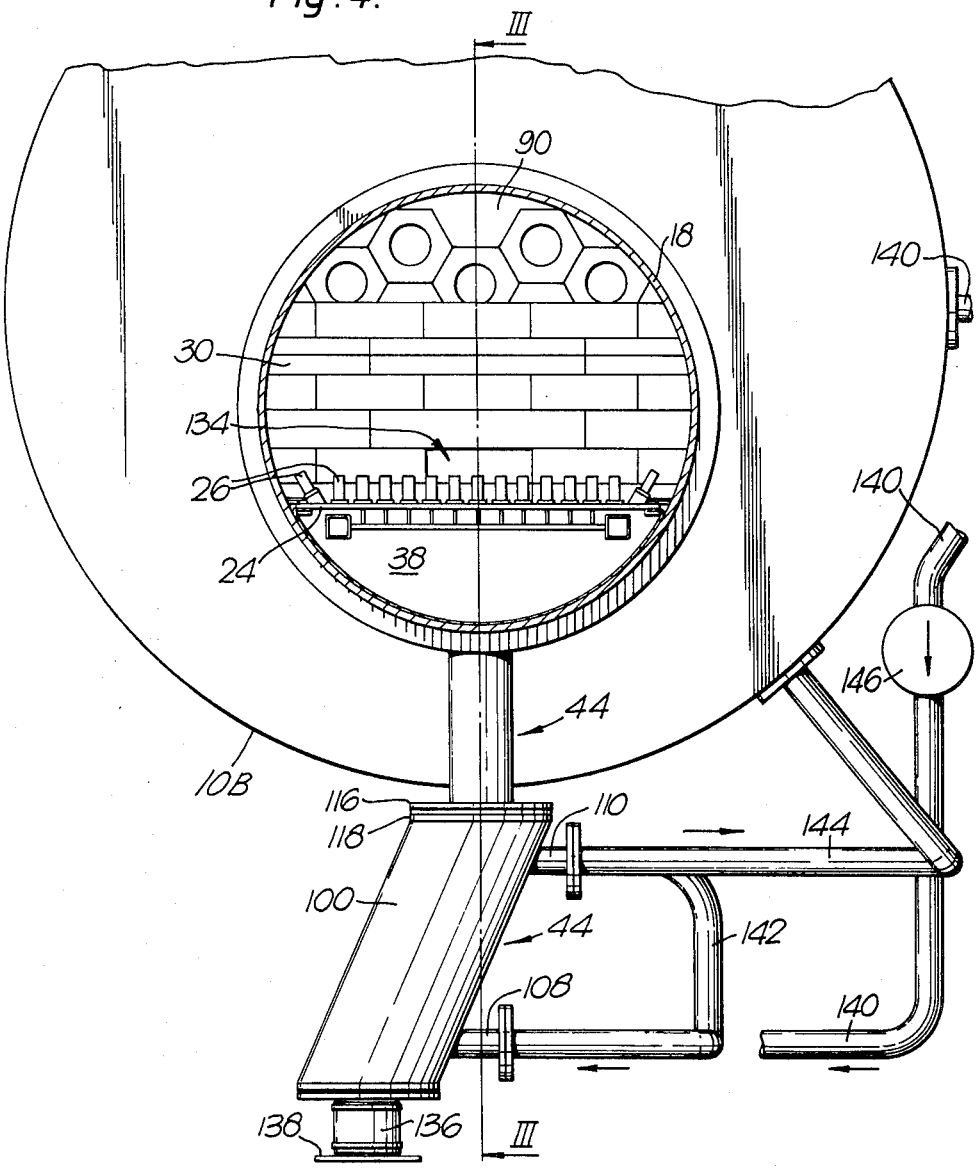
FIG. 4 is a front view of the boiler shown in FIG. 3 partly in vertical section on the line IV—IV in FIG. 3.

In the modified apparatus in the form of a boiler shown in FIGS. 3 and 4 (in which parts similar to those shown in FIGS. 1 and 2 have the reference numerals corresponding to those used in FIGS. 1 and 2) the valves 45, 47 have been dispensed with. When the conveyors are inoperative material cannot pass out of the conduits 42, 44 because flow is prevented by the respective conveyors. The rear end of the boiler is not shown in FIGS. 3 and 4 but in the same way the valves in the conduits 52, 54 and 64 can be dispensed with. The valves are optional and may be provided if necessary to ensure gas tightness at a particular conduit or to enable selective withdrawal of material to be effected.

The conduits 42 and 44 have water-cooling jackets outside the shell 10. Each jacket consists of an outer case 100, a layer of glass-fibre insulation 102 an inner case 104 spaced from the conduit, a water space 106 between the conduit and the inner case 104 and a water inlet 108 and outlet 110 which communicate with the water space 106.

In this modification the conduits 42, 44 are inclined sideways below the shell 10 to suit the position of the conveyor beneath.

The front conduit 44 is made up of an outer conduit sleeve 112 and a stainless steel insert conduit 114 which has an annular flange secured to its lower end and located between flanges 116, 118 on the outer sleeve 112 and the outer case 100, respectively. Within the water jacket the conduit is formed by an inner conduit piece 120 secured to the flange 118.

The rear conduit 42 is made up of an upright cylindrical passage 122 through an upright firebrick block 124, the passage 122 communicates with a conduit piece 126 similar to the piece 120.

The upper part of the block 124 is built into the wall 30. The lower part extends down through an upright cylindrical outlet 125 which is connected at its upper end to the furnace tube 18 at a lower outlet therefrom and which passes out of the shell 10 through an opening in the lower side thereof. The block 124 is supported by refractory filling 127 in the outlet 125 and by a lower closure plate 129 attached to the lower end of the outlet 125. The latter is welded to the furnace tube 18 and to the shell 10 to complete the pressure vessel containment which is formed by the boiler shell 10.

The top of the insert conduit 114 is open and is approximately level with lateral air-outlets, which are too small to be shown in the drawings, extending through the cylindrical side-walls of the nozzles 26.

The top of the insert conduit 114 opens into a space 128 extending beneath the front refractory protecting the front closure 80 of the furnace tube 18. The space 127 extends across the bed containment 22.

The lower boundary of the containment 22 includes the rectangular steel plate 24 which forms support structure for the rectangular array of nozzles 26.

The insert conduit 114 is upstream of the main zone of combustion in or above the containment 22 and so is not exposed to excessive heat input. Furthermore, it is air cooled by the flow of air indicated by the arrows in the plenum chamber 38 in FIG. 3 across which the conduit 44 extends.

The rear conduit 42 is also out of the main heat zone since it is within the wall 30 and is in any case made of refractory material at the containment and so is not exposed to maximum heat input and is also very resistant to heat.

Some of the nozzles 26 are shown accommodating gas supply nozzles 130 which supply gas for ignition of the coal in the bed.

The upper end of the passage 122 opens into a rectangular chamber 132 which has an open side extending transversely at 134 across a central part of the bed containment.

The lower end of each conduit 42, 44 is connected to a flexible rubber sleeve 136 which in turn is connected to a lower stub-pipe having a flange 138 by which connection is made to the conveyor beneath.

When the boiler shown in FIGS. 3 and 4 is operated and the bed is fluidised in the containment 22, material on top of the plate 24 but below the level of the air-outlets of the nozzles 26, that is below the level of the top of the insert conduit 114, is not disturbed and forms a quiescent layer which protects the plate 24 from excessive heat input.

Typically, for example, the air-outlets are five centimeters (two inches) above the plate 24 so that the quiescent layer is of that depth also, or slightly less.

The water spaces 106 are fed by water which passes through an external pipe indicated at 140 including a circulating pump 146 from an upper part of the shell 10 to the inlet 108 of the rear water jacket, out of the outlet 110 of that jacket, along a further pipe indicated at 142, into the inlet 108 of the forward jacket, out of the outlet 110 and back into the shell 10 by way of another external pipe indicated at 144 (FIG. 4).

When required while the boiler is on load the conveyors 46, 50 are operated which, in the case of the conveyor 46 to which the conduits 42, 44 lead, causes material from above the level of the top of the insert conduit 114 to flow down through the insert conduit 116 and through the passage 122. Those flows are accompanied by flows from the central region of the bed towards the conduits 42, 44.

The fluidised material including ash is very hot and risk of damage to the conveyors by excessive temperatures is avoided by the cooling action of the water jackets which remove a certain amount of heat from the material. The heat removed is returned at least in part to the boiler shell in the cooling water. The temperature of the material removed from the bed is reduced to a safe level.

Material may also be removed from the bed while the boiler is not on load in which the material removed will be relatively cold.

The details shown in FIGS. 3 and 4 are, with the exception of the omission of the valves and the provision of water cooling, present in the boiler shown in FIGS. 1 and 2. The wall 30 is made up of rectangular firebricks. The baffle 90 is made up of hexagonal firebricks each having a gas through-flow opening which diverges in the direction of gas flow. The baffle 90 includes refractory mortar closing the gaps between the firebricks and between them and the furnace tube 18.

In FIGS. 3 and 4 the shell proper is shown as 10A in FIG. 3 with the outermost casing shown at 10B in both Figures.

In both of the boilers described with reference to the drawings, some bed material is inevitably irretrievably lost as boiler operation continues and that loss must be made up. It is preferred to provide a hopper (not shown) which feeds make-up bed material into the conveyor 50 as required.

The layer of quiescent material extends right to the closure 80 (FIG. 3) at the rear of the front of the furnace tube 18 and since the array of fluidising nozzles 26 stops short of the closure 80 there will be a tendency for the layer to rise up towards the upper surface of the closure 80. Bed material will fill up the gap shown in FIG. 3 between the sleeve 112 and the insert conduit 114. The layer of quiescent material extends right up to the front surface of the wall 30. The quiescent material therefore affords protection to the upper ends of the conduits 42, 44 as well as to the plate 24 and lower ends of the nozzles 26.

What is claimed is:

1. Fluidised bed combustion apparatus comprising a horizontal furnace duct, containment means within said duct, particulate inert fluidisable bed material forming a fluidisable bed in said containment, first means operable to feed particulate solid fuel to said bed in said containment means through a first upstream end of said duct, second means operable to feed air into said bed to fluidise the same, a combustion chamber into which said duct opens at a second downstream end thereof, horizontal firetubes conducting gaseous products of combustion of said fuel from said combustion chamber outside said duct, said firetubes and said combustion chamber forming with said duct a path for gas leaving said containment, said containment comprising a base for supporting said bed, said second means comprises nozzles upstanding from said base, each said nozzle defining fluidizing fluid outlets therefrom within said containment but spaced above said base thereof, whereby material of said bed only in an upper zone thereof extending above said fluid outlets is fluidized and material of said bed in a lower zone thereof intermediate said upper zone and said base and overlying the latter is left quiescent, first conduit means which have open upper end means in said containment above said base and which pass downwardly out of said duct, means operable to conduct coolant water in non-contacting heat-exchange relationship with material removed from said bed by said first conduit means, second conduit means leading from said path downstream of said containment, screening mechanism to which said first and second conduit means lead, conveyor means in material receiving relationship with said screening mechanism, said mechanism being operable to separate materials into a first class of relatively larger particles and a second class of relatively smaller particles including inert bed material and to convey said second class back to said containment.

2. Apparatus according to claim 1, in which said containment comprises at a downstream end thereof a wall upstanding higher than said nozzles and in which said first conduit means comprises two conduits extending past said base beyond respective ends thereof, one said conduit extending within said wall of said containment.

3. Apparatus according to claim 2, in which said conduits outside said duct have respective cooling jackets forming said coolant conducting means, pipe means being connected to said jackets to circulate water coolant therethrough.

4. Apparatus according to claim 1, 2 or 3, in which said second conduit means leads from said combustion chamber.

* * * * *